US010012096B2

(12) United States Patent
Kim et al.

(10) Patent No.: US 10,012,096 B2
(45) Date of Patent: Jul. 3, 2018

(54) TURBINE WITH BUCKET FIXING MEANS

(71) Applicant: DOOSAN HEAVY INDUSTRIES & CONSTRUCTION CO., LTD., Changwon-si, Gyeongsangnam-do (KR)

(72) Inventors: Jung Chan Kim, Busan (KR); Young Ho Ju, Changwon-si (KR); Jung Ho Lee, Busan (KR); Tae Sub Oh, Gimhae-si (KR); Cheol Hong Kim, Changwon-si (KR)

(73) Assignee: DOOSAN HEAVY INDUSTRIES & CONSTRUCTION CO., LTD., Changwon-si (KR)

( * ) Notice: Subject to any disclaimer, the term of this patent is extended or adjusted under 35 U.S.C. 154(b) by 746 days.

(21) Appl. No.: 14/515,230

(22) Filed: Oct. 15, 2014

(65) Prior Publication Data

US 2015/0104319 A1 Apr. 16, 2015

(30) Foreign Application Priority Data

Oct. 16, 2013 (KR) ..... 10-2013-0123525

(51) Int. Cl.
*F01D 5/30* (2006.01)
*F01D 5/32* (2006.01)

(52) U.S. Cl.
CPC ..... *F01D 5/303* (2013.01); *F01D 5/3053* (2013.01); *F01D 5/323* (2013.01)

(58) Field of Classification Search
CPC ..... F01D 5/323; F01D 5/3053; F01D 5/3007
See application file for complete search history.

(56) References Cited

U.S. PATENT DOCUMENTS 2,658,718 A * 11/1953 Walker ..... B23P 15/006 416/220 R
3,313,519 A * 4/1967 Jenson ..... F01D 5/30 416/217
4,093,399 A * 6/1978 Glenn ..... F01D 5/087 416/193 A
4,460,316 A * 7/1984 Partington ..... F01D 5/225 416/191
5,368,444 A * 11/1994 Anderson ..... F01D 5/3092 416/220 R
5,474,421 A * 12/1995 Rossmann ..... F01D 5/26 416/203
7,798,779 B2 * 9/2010 Nogami ..... F01D 5/147 416/220 R (Continued)

*Primary Examiner* — Justin Seabe
(74) *Attorney, Agent, or Firm* — Sughrue Mion, PLLC

(57) ABSTRACT

Provided is a turbine including a rotor wheel including a plurality of dovetail grooves and a insertion groove, the insertion groove including a first catching groove; a plurality of first buckets, each of the plurality of first buckets including a vane, a platform provided at a first end portion of the vane, and a dovetail provided at the platform and having a shape corresponding to the dovetail groove; a second bucket including a vane, a platform provided at a first end portion of the vane, and a protrusion portion and configured to be inserted into the insertion groove, the protrusion portion including a second catching groove; and a fixing member configured to be inserted into each of the first and second catching grooves, the fixing member configured to restrict radial movement of the second bucket.

22 Claims, 9 Drawing Sheets

(56) References Cited

U.S. PATENT DOCUMENTS 8,651,820 B2 * 2/2014 Krikunov ..... F01D 5/3007
416/215
8,662,852 B2 * 3/2014 Bhokardole ..... F01D 5/3007
416/218

* cited by examiner

TURBINE WITH BUCKET FIXING MEANS

CROSS-REFERENCE(S) TO RELATED APPLICATIONS

This application claims priority to Korean Patent Application No. 10-2013-0123525, filed on Oct. 16, 2013, the disclosure of which is incorporated herein by reference in its entirety.

BACKGROUND OF THE INVENTION

1. Field of the Invention

Exemplary embodiments of the present invention relate to a turbine, and more particularly, to a turbine in which rotor blades (buckets) are detachably fixed to a rotor wheel.

2. Description of the Related Art

A steam turbine is an apparatus which converts kinetic energy into rotational force by rotating blades using high-temperature and high-pressure steam generated by a large boiler for a power plant. The steam turbine is classified into a high-pressure turbine, a medium-pressure turbine, and a low-pressure turbine and maximizes efficiency.

FIG. 1 is a perspective view illustrating an example of buckets according to the related art. Each bucket 10 includes a vane 11, a shroud 12 formed at a radial outer end portion of the vane 11, and a dovetail 13 formed at a radial inner end portion of the vane 11.

The dovetail 13 is a component for fixing the bucket 10 to a rotor wheel 14. The dovetail 13 may be classified into (1) a tangential entry type, (2) an axial entry type, (3) a pinned finger type, and (4) a keyed axial entry type, according to a manner of coupling the dovetail 13 to the rotor wheel 14. In the types of numbers (1) and (3), the dovetail is tangentially (or circumferentially) inserted and coupled to the rotor wheel. In the types of numbers (2) and (4), the dovetail 13 is axially inserted and coupled to the rotor wheel 14.

The dovetail 13 shown in FIG. 1 is an axial entry type dovetail. Referring to FIG. 1, dovetail grooves 15 are circumferentially formed at intervals on a circumferential portion of the rotor wheel 14. Each of the dovetail grooves 15 has a cross-sectional shape in the form of a corrugation at both axial sides thereof based on a radial cross-section thereof. In this case, the dovetail 13 of the bucket 10 also has a shape corresponding to the dovetail groove 15. That is, the dovetail 13 and the dovetail groove 15 have a male and female coupling relation.

In a method of assembling the bucket 10 in which the axial entry type dovetail 13 is applied, the bucket 10 integrally includes the shroud 12, the vane 11, and the dovetail 13, and the bucket 10 is axially inserted and assembled to the dovetail groove 15 using the dovetail 13 along the circumferential portion of the rotor wheel 14.

In the conventional method of assembling the bucket 10 of the steam turbine in which the axial entry type dovetail 13 is applied, there is however a problem in that it is impossible to assemble a second bucket 20 which is finally assembled since the second bucket 20 interferes with the adjacent bucket 10 (the shroud 12, a platform 11*a*, and the vane 11).

In this regard, U.S. Pat. No. 6,030,178 discloses a method of opening adjacent buckets 10 in opposite directions (a tangential direction; ①) and then inserting a second bucket 20 in a radial direction (②) so that the second bucket 20 is seated and installed to a rotor wheel 14. Finally, a so-called Caruso key 16 is simultaneously inserted and coupled to a dovetail groove 15 of the rotor wheel 14 and a dovetail groove 21 of the second bucket 20 in an axial direction (③).

However, the above related art has the following problems.

First, in order to insert the Caruso key 16, the existing dovetail (a protruding portion) should be cut and the dovetail groove 21 should be separately formed on a platform (a root portion) 11*a* of the second bucket 20, thereby increasing the sizes of the buckets 10 and 20. Thus, there are problems in that centrifugal stress of the buckets 10 and 20 is increased and a consumed bucket material is increased.

Secondly, since the Caruso key 16 is made of an inconel material so as to withstand high centrifugal stress, it has heat transfer properties different from the bucket made of a steel material. Therefore, due to excessive thermal stress caused by a difference in thermal expansion at hot parts of the key, there may be a limit in terms of a design. In addition, since the key itself has a complicated shape, the key may have poor machinability and material costs thereof may be increased.

SUMMARY OF THE INVENTION

Therefore, the present invention has been made in view of the above problems, and it is an object of the present invention to provide a turbine capable of being more easily assembled compared to the related art.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, there is provided a turbine including a rotor wheel including a plurality of dovetail grooves and a insertion groove, the plurality of dovetail grooves and the insertion groove arranged in a circumferential direction of the rotor wheel, the insertion groove including at least one first catching groove provided on an inner surface of the insertion groove; a plurality of first buckets, each of the plurality of first buckets including a first vane, a first platform provided at a first end portion of the first vane, and a dovetail provided at the first platform and having a shape corresponding to a shape of a corresponding dovetail groove of the plurality of dovetail grooves; a second bucket including a second vane, a second platform provided at a first end portion of the second vane, and a protrusion portion provided at the platform and configured to be inserted into the insertion groove, the protrusion portion including at least one second catching groove; and a fixing member configured to be inserted into each of the at least one first catching groove and the at least one second catching groove, the fixing member configured to restrict radial movement of the second bucket.

The at least one second catching groove may include a plurality of second catching grooves, the plurality of second catching grooves are respectively provided on opposite sides of the protrusion portion.

The protrusion portion of the second bucket may be configured to be radially inserted and coupled to the insertion groove.

The protrusion portion may include a side portion having a circumferential width decreasing as advancing toward a center of the rotor wheel.

The at least one first catching groove may include a plurality of first catching grooves, and the plurality of first and second catching grooves may be radially spaced along sides of the protrusion portion respectively.

The fixing member may have a circular cross-sectional shape.

The first bucket may further include a first shroud which is integrally provided at a second end portion of the first vane; the second bucket may further include a second shroud which is integrally provided at a second end portion of the second vane; and each of the first and second shrouds may include: a planar portion which is tangentially provided at an outer end portion of the first and second vanes; and protrusion hooks radially protruding from opposite end portions of the planar portion, respectively.

Each of the first and second shrouds may include axial decoupling prevention portions circumferentially inclined from an axial end portion of the planar portion and the protrusion hooks may be arranged adjacent to the axial decoupling prevention portions.

Each of the first and second platforms may have a flat plate shape, and include axial decoupling prevention portions circumferentially inclined from opposite sides of an axial end portion of each of the first and second platforms.

Each of opposite end portions of the fixing member may include an axial decoupling prevention hook, the axial decoupling prevention hook configured to protrude circumferentially and radially.

The axial decoupling prevention hook may include a rivet.

The at least one first catching groove and the at least one second catching groove have different depths from each other.

In accordance with another aspect of the present invention, there is provided a turbine including a rotor wheel including: a plurality of dovetail grooves; and a insertion groove provided between the plurality of dovetail grooves; a plurality of first buckets, each of the plurality of first buckets including a dovetail configured to engage with a corresponding dovetail groove of the plurality of dovetail grooves; a second bucket including a protrusion portion inserted into the insertion groove; and a fixing member including: a first portion inserted into an outer wall of the insertion groove; and a second portion inserted into an outer wall of the protrusion portion with respect to a circumferential direction of the fixing member, wherein the fixing member is configured to restrict radial movement of the second bucket.

The fixing member may be inserted into each of at least one first catching groove concavely provided on the outer wall of the insertion groove and at least one second catching groove concavely provided on the outer wall of the protrusion portion.

The fixing member may have one of a circular cross-sectional shape, an oval cross-sectional shape, and a polygonal cross-sectional shape.

The fixing member may include a plurality of fixing members and the plurality of fixing members inserted into each of opposite sides of the protrusion portion.

A circumferential distance between first catching grooves provided on opposite surfaces of the insertion groove and facing each other provided within the insertion groove may be decreased as advancing toward a center of the rotor wheel.

Each of the first and second buckets further may include a shroud which is integrally formed at one end portion thereof.

Each of opposite end portions of the fixing member may include a deformation portion, and the deformation portion may protrude from a side of the rotor wheel and configured to be mechanically deformed.

The deformation portion may include a radially expanded portion.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

Exemplary embodiments of the present invention will be described below in more detail with reference to the accompanying drawings so as to be realized by a person of ordinary skill in the art.

Although the present invention is described below as to be applied to a steam turbine in which a second bucket 240 may be assembled during assembly of buckets (rotor blades) axially inserted into a rotor wheel, the present invention is not limited thereto. For example, the present invention may also be applied to any turbine, such as a gas turbine, having a structure for inserting a plurality of buckets or vanes into the rotor wheel.

Figure 1:
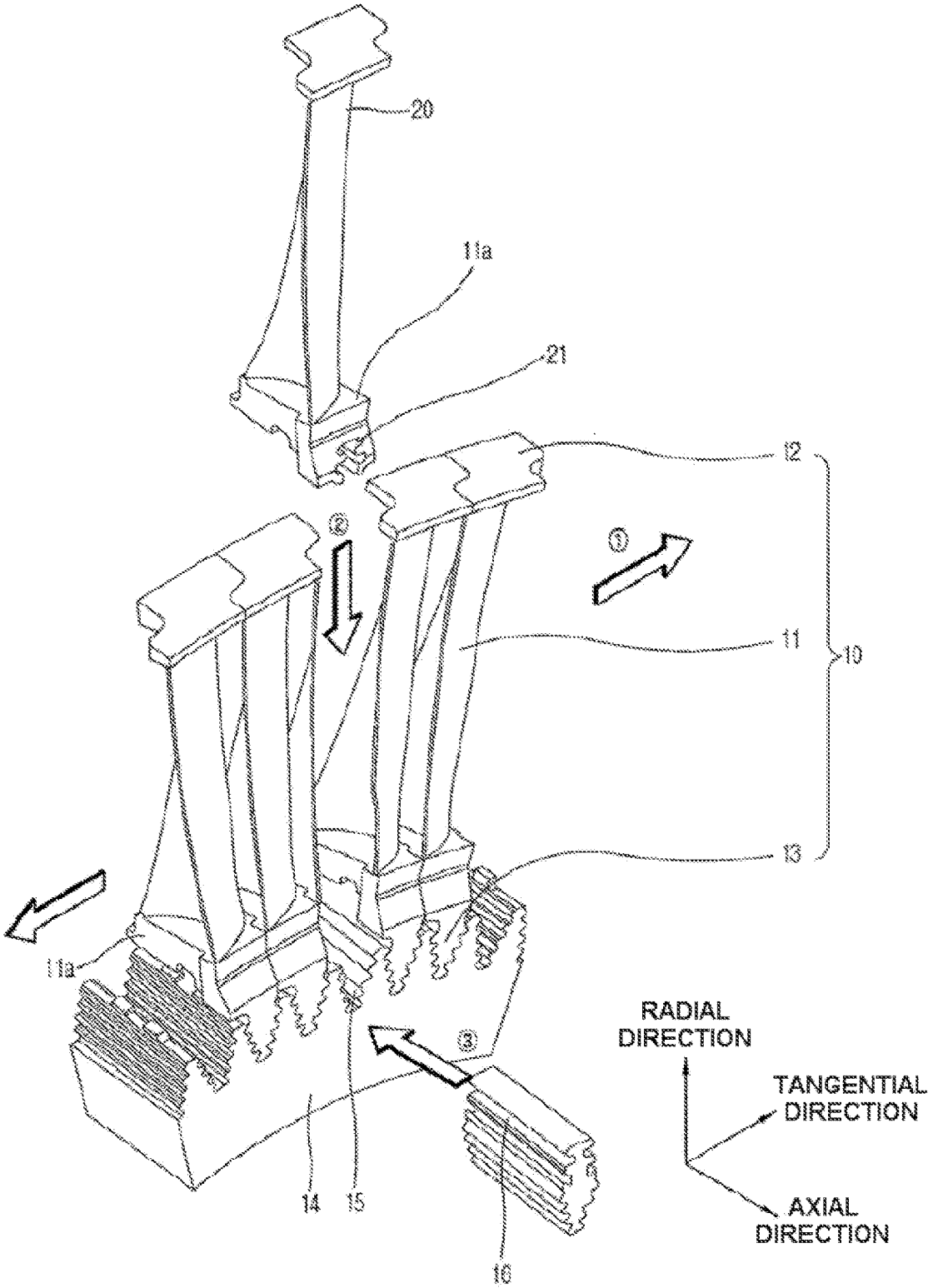
FIG. 1 is a perspective view illustrating an example of buckets according to the related art.
Figure 2:
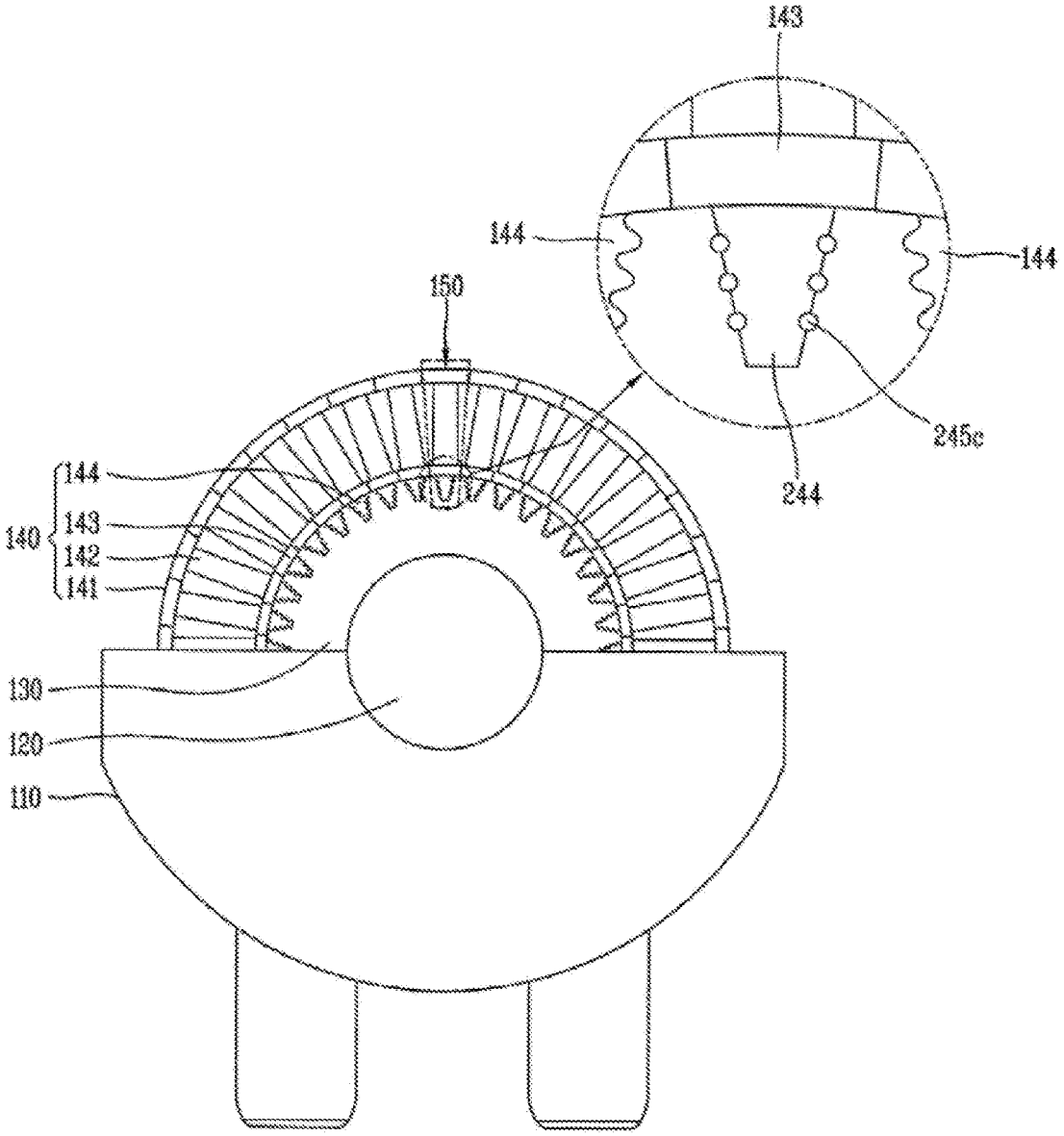
FIG. 2 is an axial front view schematically illustrating an internal configuration of a steam turbine according to an embodiment of the present invention.

FIG. 2 is an axial front view schematically illustrating an internal configuration of a steam turbine according to an embodiment of the present invention.

Referring to FIG. 2, the steam turbine according to the present invention includes a casing 110, a rotor 12, a rotor wheel 130, and buckets 140.

The casing 110 is configured of an upper casing (not shown) and a lower casing 110 which may be coupled to and decoupled from each other, and receives the rotor wheel 130 and the buckets 140 therein, thereby enabling internal components to be blocked or protected from external impacts or foreign matters. The drawing shows only the lower casing 110 to illustrate the internal components.

The rotor 120 may serve as a rotary shaft and both end portions of the rotor 120 may be rotatably supported by bearings.

The rotor wheel 130 may have a circular or disc shape. The rotor wheel 130 has a hollow hole provided at a central portion thereof, and the rotor 120 is coupled to the rotor wheel 130 through the hollow hole so that the rotor 120 and the rotor wheel 130 may integrally rotate. In this case, a key or a serration may be coupled between the rotor 120 and the rotor wheel 130 so as to simultaneously operate the rotor 120 and the rotor wheel 130.

In addition, the rotor wheel 130 has a plurality of dovetail grooves 131 which are circumferentially formed at intervals on a circumferential portion thereof. Each of the dovetail grooves 131 has a certain depth which is axially formed from the outermost edge of the rotor wheel 130. Engagement portions 131*a* having a corrugated curved surface are symmetrically formed on inner surfaces of the dovetail groove 131 on the basis of an imaginary radial center line, so as to engage with a corresponding dovetail 144.

The dovetail groove 131 is radially outwardly opened, and has a circumferential width which becomes smaller as the depth of the groove becomes deeper. The dovetail groove 131 is also axially opened such that the dovetail 144 of the associated bucket 140 to be described later may be inserted and coupled to the dovetail groove 131. In this case, the circumferential width of the dovetail groove 131 is maintained at a certain distance in an axial direction thereof for smooth insertion of the dovetail 144.

The buckets 140 each integrally include a shroud 141, a vane 142, and a dovetail 144, and are axially inserted and mounted along a circumferential surface of the rotor wheel 130 using the dovetails 144. Here, each of the buckets 140 may have any shape including the associated dovetail, and will be referred below to as "a first bucket" for distinguishing with a second bucket to be described later.

The shroud 141 is called as a cover and is installed to a radial outer end portion of the vane 142 so as to serve to prevent a leakage of steam and attenuate vibration. The shroud 141 may have any shape such as a Z-shape, a V-shape, or a linear shape when viewed from the outward and radial direction thereof.

The vane 142 may have various cross-sectional shapes such as a crescent shape and an airfoil shape, and may increase rotational force by generating lift force when a fluid passes through the vane 142 and by doubling velocity energy of the fluid. The vane 142 having such a shape may have a cross-sectional area which increases or decreases as advancing in a longitudinal direction thereof.

The dovetail 144 is an axial entry type dovetail which is axially inserted and coupled to the dovetail groove 131.

A plate-shaped platform 143 is formed at a radial inner end portion of the vane 142. The dovetail 144 is integrally formed at the platform 143 of the vane 142 so as to radially inwardly protrude.

The dovetail 144 is preferably designed to properly withstand centrifugal stress of the first bucket 140 during rotation thereof, and may have, for example, a corrugated shape.

In more detail, the dovetail 144 has a circumferential width, which becomes smaller as advancing in a depth direction of the dovetail groove 131 but is uniformly maintained as advancing in an axial direction of the dovetail groove 131.

In addition, both circumferential sides of the dovetail 144 are configured of a planar surface, and engagement portions 131*a* having a curved surface are symmetrically formed on both axial sides of the dovetail 144 on the basis of a radial center line of the dovetail 144. The curved surface may have a corrugated shape in the depth direction of the groove.

The dovetail 144 having the above structure is axially inserted into the dovetail groove 131, and the dovetail 144 and the dovetail groove 131 engage with each other in a male and female form by the engagement portions 131*a*. Consequent, the dovetail 144 may withstand centrifugal stress of the first bucket 140 during rotation thereof.

Figure 3:
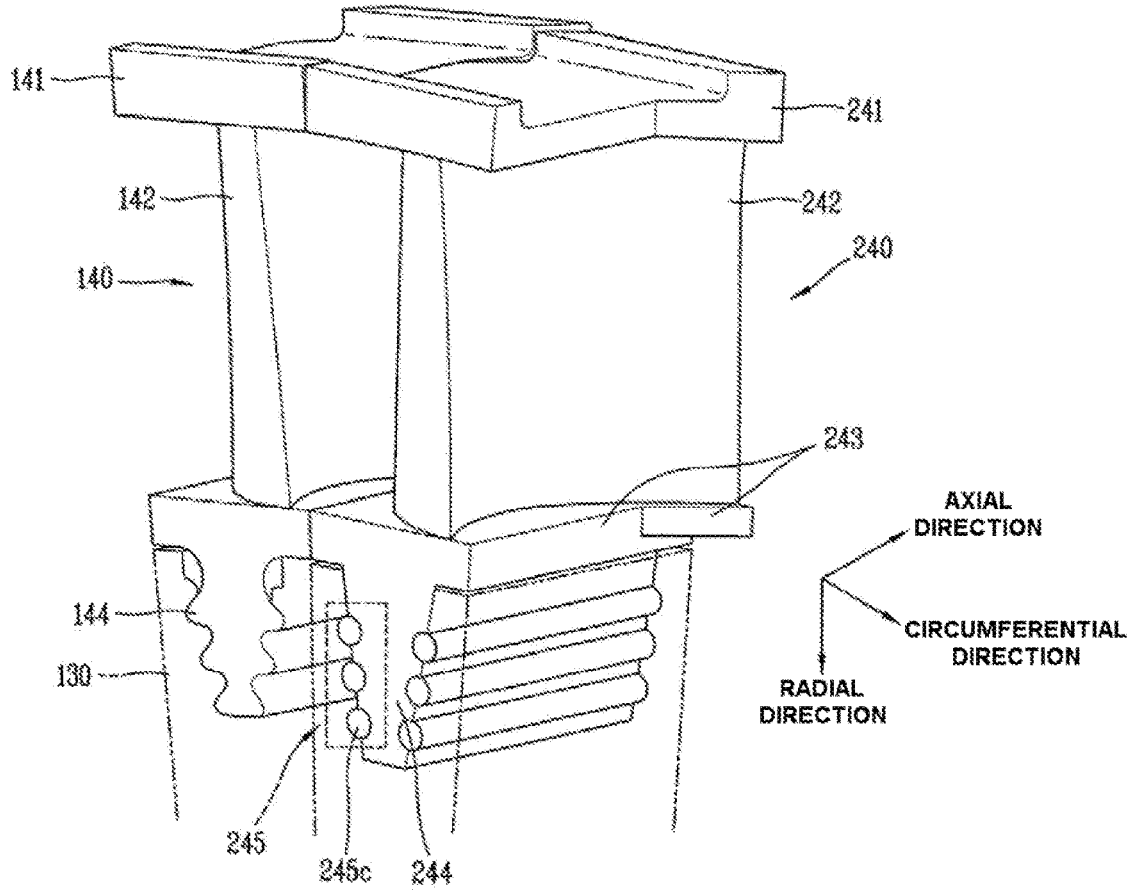
FIG. 3 is a perspective view illustrating a coupling structure between buckets and a rotor wheel according to the embodiment of the present invention.
Figure 4:
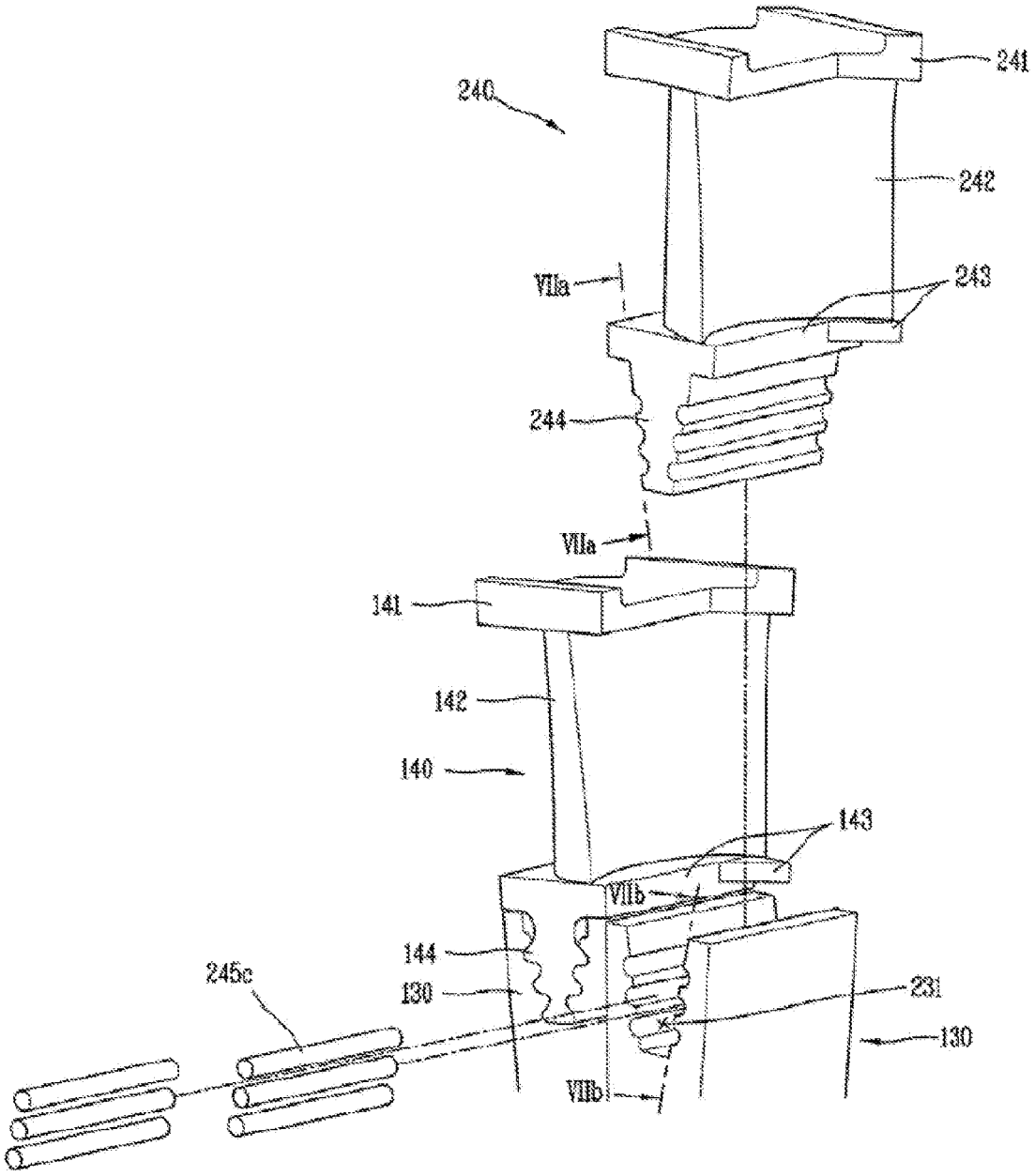
FIG. 4 is an exploded perspective view illustrating a second bucket in FIG. 3.
Figure 5:
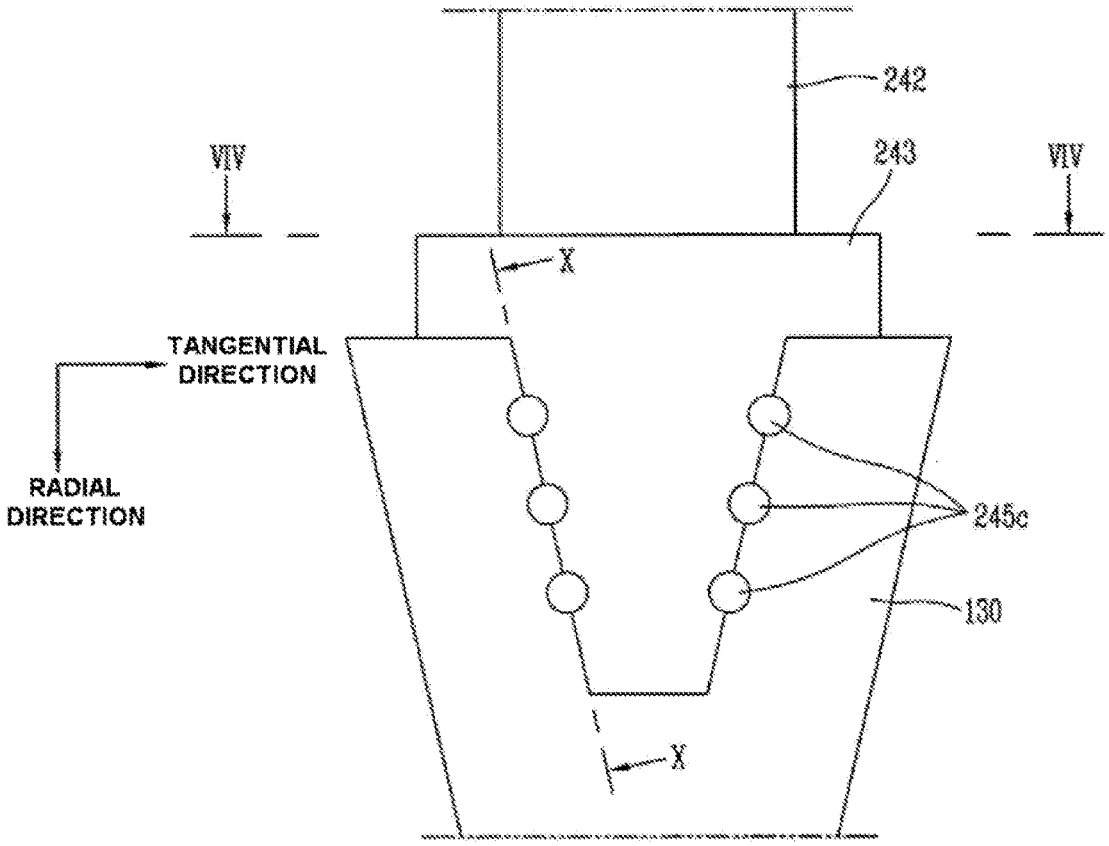
FIG. 5 is an axial front view illustrating a coupling structure between the second bucket and the rotor wheel in FIG. 3.
Figure 6A:
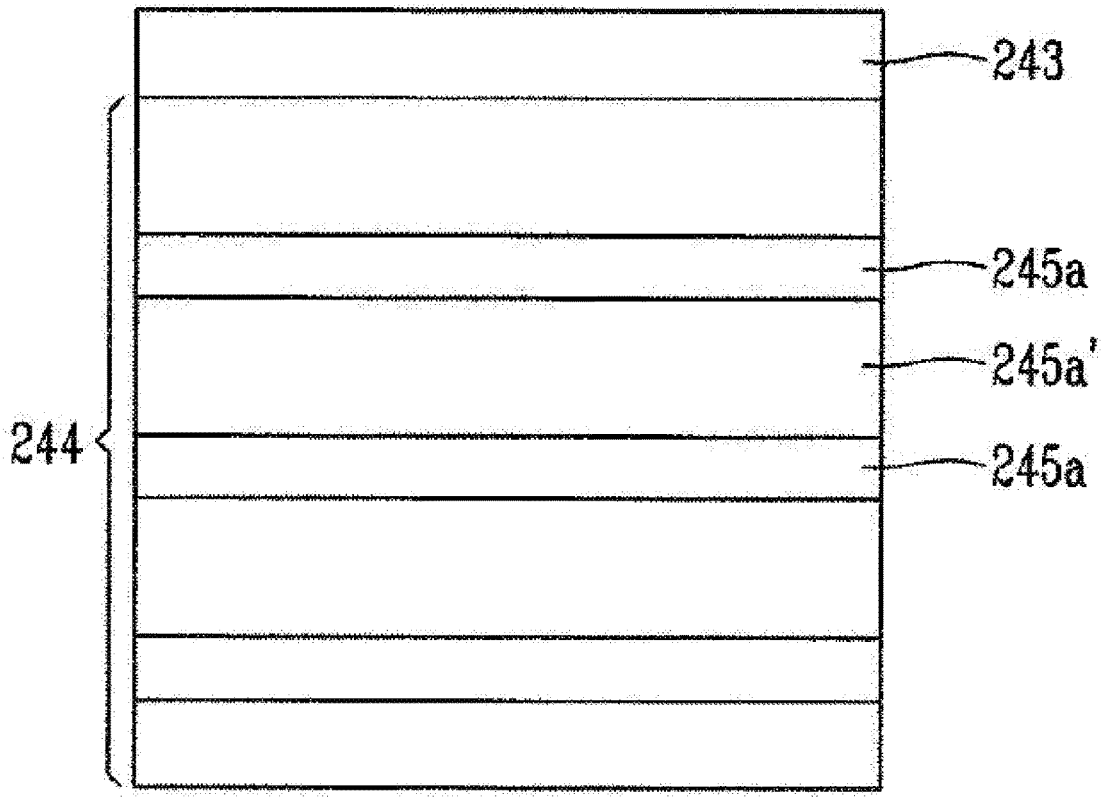
FIG. 6A is a circumferential side view taken along line VIIa-VIIa of FIG. 4
Figure 6B:
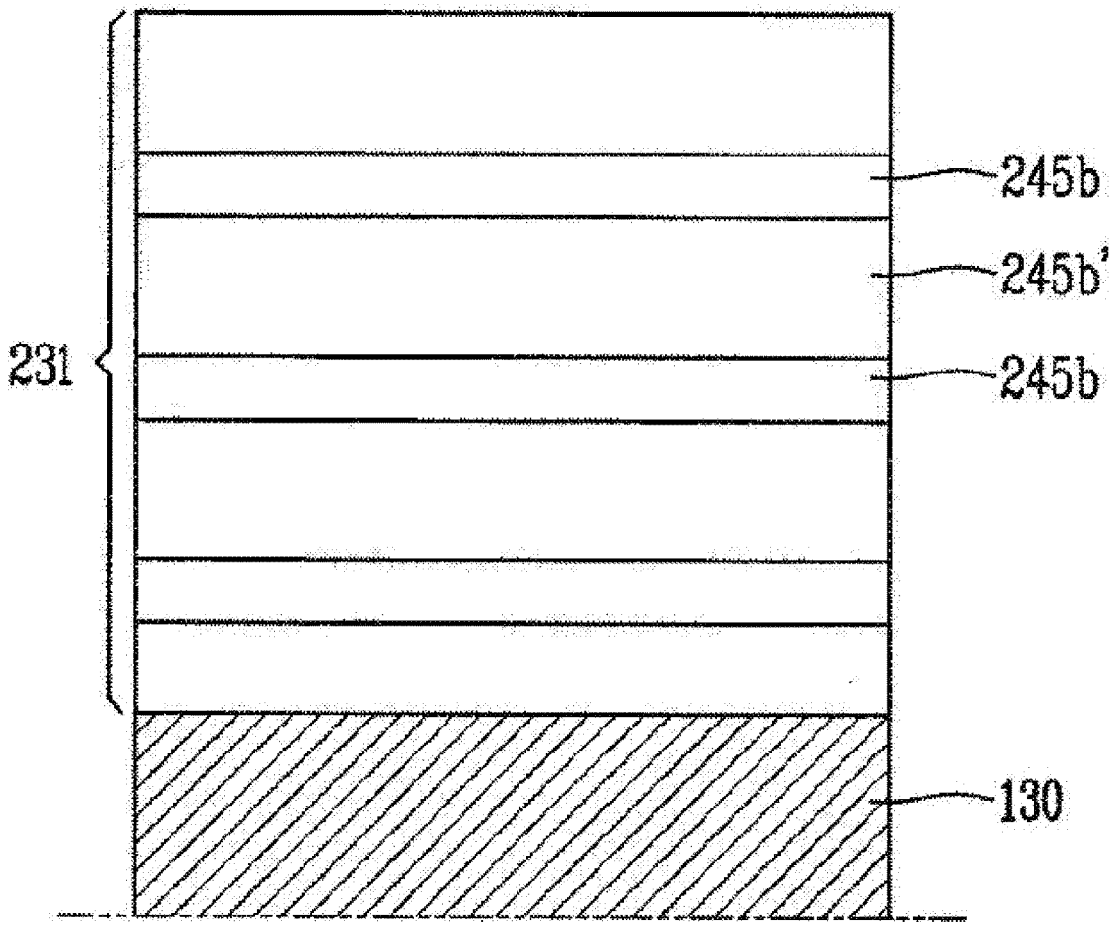
FIG. 6B is a circumferential side view taken along line VIIb-VIIb of FIG. 4.

FIG. 3 is a perspective view illustrating a coupling structure between the buckets and the rotor wheel according to the embodiment of the present invention. FIG. 4 is an exploded perspective view illustrating a second bucket in FIG. 3. FIG. 5 is an axial front view illustrating a coupling structure between the second bucket and the rotor wheel in FIG. 3. FIG. 6A is a circumferential side view taken along line VIIa-VIIa of FIG. 4 and FIG. 6B is a circumferential side view taken along line VIIb-VIIb of FIG. 4.

Here, the first buckets 141 are inserted and coupled to the rotor wheel 130 using the dovetails. However, a second bucket 240, which is finally assembled to the rotor wheel 130 among the first buckets 140, differs from the other first buckets 140 in that the second bucket 240 has a different shape and structure from the first buckets 140. Here, the second bucket may also be provided in plural numbers.

That is, the second bucket 240 differs from the first buckets in that the second bucket 240 includes a protrusion portion 244 inserted into an insertion groove 231 formed on the rotor wheel 130 and is coupled to the rotor wheel by a fixing member interposed between the insertion groove and the protrusion portion.

The protrusion portion 244 of the second bucket 240 has a plurality of first catching grooves 245*a* on axial side portions thereof which are circumferentially spaced apart from each other. The axial side portions have a circumferential width which becomes smaller as radially inwardly advancing, and are symmetrically formed to be inclined toward each other on the basis of a radial center line. The first catching grooves 245*a* are each formed to be axially elongated and are radially spaced apart from each other. A planar connection portion 245*a*' is formed between the first catching grooves 245*a*.

The insertion groove 231 of the rotor wheel 130 into which the protrusion portion 244 of the second bucket 240 is inserted has a plurality of second catching grooves 245*b* on axial side portions thereof which are circumferentially spaced apart from an inner surface of the insertion groove 231. The axial side portions have a circumferential distance which becomes smaller as radially inwardly advancing, and are symmetrically formed to be inclined toward each other on the basis of a radial center line. The second catching grooves 245*b* are each formed to be axially elongated and are radially spaced apart from each other. A planar connection portion 245*b*' is formed between the second catching grooves 245*b*.

The protrusion portion 244 and the insertion groove 231 come into surface contact with each other through the connection portions 245*a*' and 245*b*'. Each of the first catching grooves 245*a* of the protrusion portion 244 and each of the second catching grooves 245*b* of the insertion groove 231 may have a semicircular shape in section and may form one circle when facing each other at positions corresponding to each other. Such a formed circular hole provides a space into which each circular fixing member 245*c* may be inserted.

Figure 9:
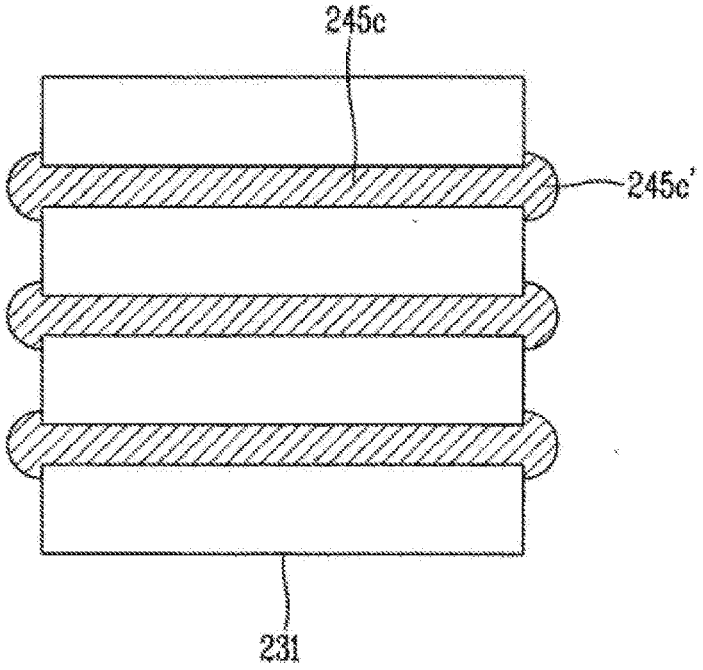
FIG. 9 is a cross-sectional view taken along line X-X of FIG. 5.

FIG. 9 is a cross-sectional view taken along line X-X of FIG. 5.

Here, the fixing member 245*c* is a fixing element 245 which fix the protrusion portion 244 and the insertion groove 231 through the first and second catching grooves 245*a* and 245*b*. The fixing member 245*c* may have a bar shape having a relatively small diameter and a long length. The first and second catching grooves 245*a* and 245*b* receive the fixing member 245*c* so as to come into substantially half contact with the fixing member 245*c*.

Both end portions of the fixing member 245*c* are provided with axial decoupling prevention hooks 245*c*' each of which has a diameter formed to radially outwardly protrude, so that the fixing member 245*c* may be prevented from being axially decoupled. In this case, the axial decoupling prevention hook 245*c*' may be formed by riveting. For example, the axial decoupling prevention hook 245*c*' may be processed by inserting a round headed rivet into the first and second catching grooves 245*a* and 245*b* and then striking an opposite side of the round head with a riveting tool such as a chisel. Besides, the axial decoupling prevention hook may be formed by radially expanding a portion or all of an end of the fixing member using any tool or a processing method.

Hereinafter, a method of assembling the buckets according to the present invention will be described.

The plural first buckets 140 are axially inserted and assembled to the respective dovetail grooves 131 which are circumferentially spaced along the circumferential portion of the rotor wheel 130. In this case, it is preferable that the first buckets 140 are sequentially assembled from any one of the dovetail grooves 131 in a clockwise or counterclockwise direction.

Next, the second bucket 240 is radially inserted and assembled unlike the first buckets 140.

In this case, the protrusion portion 244 of the second bucket 240 may be axially or radially inserted into the insertion groove 231. This is because, in axial insertion of the protrusion portion 244, the protrusion portion 244 of the second bucket 240 has a shape corresponding to the dovetail groove 231 on the basis of a radial cross-section thereof and has a radial cross-sectional area which is slightly smaller than that of the insertion groove 231 to such an extent as to axially insert the protrusion portion 244. In addition, this is because, in radial insertion of the protrusion portion 244, the protrusion portion 244 has a radial inner end width which is smaller than a radial outer distance of the insertion groove 231.

However, when no first bucket 140 assembled adjacent to both sides of the second bucket 240 is present or the first bucket 140 is present only at any one side of the second bucket 240, the dovetail 144 may be axially and radially inserted. However, when the first buckets 140 assembled adjacent to both sides of the second bucket 240 are present, it is preferable that the second bucket 240 is radially inserted in the present invention in order to avoid an assembly interference portion between the adjacent first buckets 140 and the second bucket 240.

Even when the insertion direction of the dovetail 144 coincides with the radial center line of the insertion groove 231 and, of course, is slightly biased to one side of the radial center line of the insertion groove 231, the protrusion portion 244 of the second bucket 240 according to the present invention obliquely slides while the axial side portion (connection portion 245*a*') of the protrusion portion 244 comes into contact with the inner side portion (connection portion 245*b*') of the insertion groove 231. Therefore, the second bucket 240 may be easily radially inserted.

Next, when the insertion of the second bucket 240 is completed, the circular bar-shaped fixing members 245*c* are simultaneously inserted into the first and second catching grooves 245*a* and 245*b* to fix the second bucket 240 and the rotor wheel 130, and thus the assembly of the buckets 140 and 240 is completed.

Particularly, the fixing member 245*c* is half inserted into the first and second catching grooves 245*a* and 245*b* to connect the protrusion portion 244 and the insertion groove 231, so that the protrusion portion 244 and the insertion groove 231 are restricted without radially deviating from each other by the first and second catching grooves 245*a* and 245*b*. Thus, the fixing member 245*c* may securely fix the second bucket 240 to the rotor wheel 130. In addition, since the fixing member 245*c* has a circular cross-sectional shape, it may properly withstand centrifugal force of the buckets 140 and 240 during rotation thereof.

Figure 7:
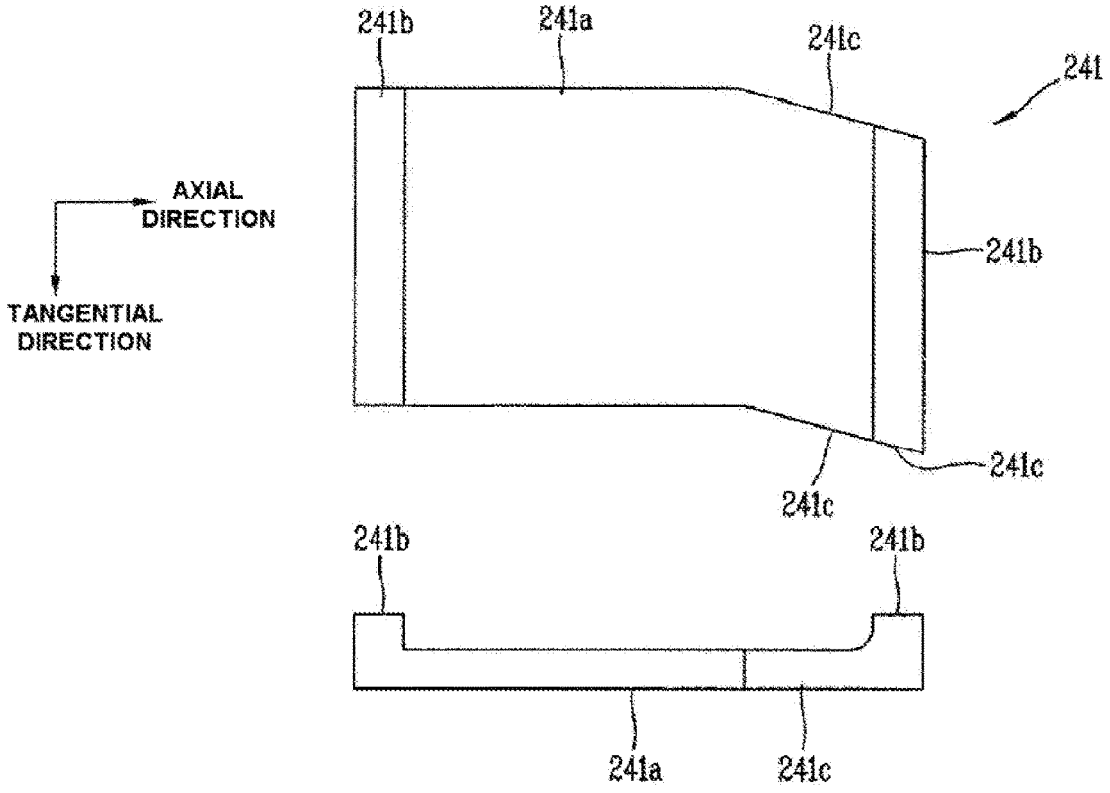
FIG. 7 is top and side views illustrating a shroud in FIG. 5.
Figure 8:
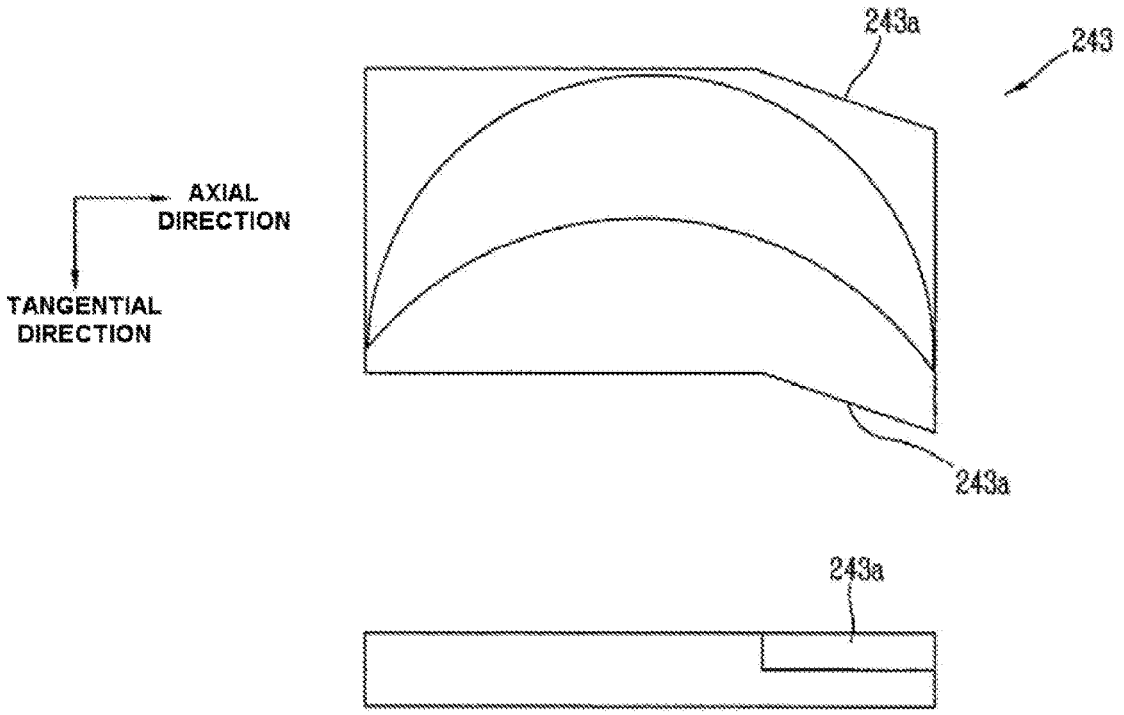
FIG. 8 is a cross-sectional view taken along line VIV-VIV of FIG. 5.

FIG. 7 is top and side views illustrating the shroud in FIG. 5. FIG. 8 is a cross-sectional view taken along line VIV-VIV of FIG. 5.

In the buckets 140 and 240 according to the present invention, the shrouds 141 and 241 may be axially configured in a linear form.

Hereinafter, structures of the shrouds 141 and 241 will be described in more detail. Each of the shrouds 141 and 241 includes a planar portion 241*a* which is tangentially arranged at a radial outer end portion of each of the vanes 142 and 242, protrusion hooks 241*b* which are axially spaced from both end portions of the planar portion 241*a* and radially outwardly protrude, and an axial decoupling prevention portion 241*c* which is tangentially inclined from an axial one end portion of the planar portion 241*a* and the protrusion hooks 241*b*.

The planar portion 241*a* may have a linear flat shape on at least both axial sides thereof.

For example, the axial decoupling prevention portion 241*c* of the shroud 241 engages and is coupled with the axial decoupling prevention portion of the adjacent shroud 141, thereby enabling the shrouds 141 and 241 to be prevented from being decoupled from the dovetail groove or insertion groove 131 or 231 within an axial length range thereof.

In addition, in the buckets 140 and 240 according to the present invention, since each of the platforms 143 and 243 is tangentially formed on the radial inner side of each of the vanes 142 and 242 and thus a separate space for insertion of the conventional Caruso key is not required, the platform 143 or 243 may have a flat plate structure having a relatively thin thickness.

In this case, the axial decoupling prevention portion 243*c* may also be applied to the platform 143 or 243 as an inclined structure such that the platform does not depart from the circumferential surface of the rotor wheel 130 within an axial length range thereof. Such a structure may be applied to the platforms 143 of the first buckets 140.

Accordingly, according to the present invention, there is no need to cut the dovetail formed integrally with the vane, form an insertion space for receiving a separate Caruso key in the platform of the vane, or circumferentially open the adjacent buckets for the radial insertion of the second bucket 240 as in a case of the conventional patent, by applying together the wedged dovetail 244 and the fixing member 245*c*. Therefore, the turbine may be easily assembled.

Besides, since the heights of the platforms 143 and 243 of the buckets 140 and 240 are lowered, it may be possible to decrease centrifugal force of the buckets 140 and 240 and reduce material costs. In addition, the rotor 120 may be simply machined and easily perform maintenance.

As is apparent from the above description, in a turbine according to the embodiments of the present invention, a last bucket may be assembled by applying a wedged dovetail and a circular bar-shaped fixing fin (fixing member) to a second bucket which is finally assembled to a rotor wheel. Thus, since a height (thickness) of a platform of each bucket becomes smaller, it may be possible to decrease centrifugal stress of the bucket and reduce material costs. Therefore, it may be possible to easily assemble the last bucket, simply process a rotor, and easily perform maintenance.

While the present invention has been described with respect to the specific embodiments, it will be apparent to those skilled in the art that various changes and modifications may be made without departing from the spirit and scope of the invention as defined in the following claims.

What is claimed is:

1. A turbine comprising:

a rotor wheel comprising a plurality of dovetail grooves and an insertion groove, the plurality of dovetail grooves and the insertion groove arranged in a circumferential direction of the rotor wheel, the insertion groove comprising at least one first catching groove provided on an inner surface of the insertion groove;

a plurality of first buckets, each of the plurality of first buckets comprising:

a first vane;

a first platform provided at a first end portion of the first vane; and a single dovetail provided at the first platform, the single dovetail having a first shape corresponding to a shape of a corresponding dovetail groove of the plurality of dovetail grooves;

a second bucket comprising:

a second vane;

a second platform provided at a first end portion of the second vane; and a single protrusion having a second shape different from the first shape of the dovetail, provided at the second platform and configured to be inserted into the insertion groove, the single protrusion comprising at least one second catching groove; and a fixing member configured to be inserted into each of the at least one first catching groove and the at least one second catching groove, the fixing member configured to restrict radial movement of the second bucket, wherein the insertion groove has a different shape from the plurality of dovetail grooves, the insertion groove comprising axial side walls that extend from an outermost radial surface of the rotor wheel to a bottommost surface of the insertion groove, the axial side walls being opposed to each other and inclined towards each other such that a circumferential distance between the axial side walls continuously decreases from the outermost radial surface of the rotor wheel to the bottommost surface of the insertion groove.

2. The turbine according to claim 1, wherein the at least one second catching groove comprises a plurality of second catching grooves, the plurality of second catching grooves are respectively provided on opposite sides of the single protrusion.

3. The turbine according to claim 1, wherein the single protrusion of the second bucket is configured to be radially inserted and coupled to the insertion groove.

4. The turbine according to claim 1, wherein the single protrusion comprises a side portion having a circumferential width decreasing as advancing toward a center of the rotor wheel.

5. The turbine according to claim 2, wherein the at least one first catching groove comprises a plurality of first catching grooves, and wherein the plurality of first and second catching grooves are radially spaced along sides of the single protrusion respectively.

6. The turbine according to claim 2, wherein the fixing member has a circular cross-sectional shape.

7. The turbine according to claim 1, wherein:

the first bucket further comprises a first shroud which is integrally provided at a second end portion of the first vane;

the second bucket further comprises a second shroud which is integrally provided at a second end portion of the second vane; and each of the first and second shrouds comprises:

a planar portion which is tangentially provided at an outer end portion of the first and second vanes; and protrusion hooks radially protruding from opposite end portions of the planar portion, respectively.

8. The turbine according to claim 7, wherein each of the first and second shrouds comprises axial decoupling prevention portions circumferentially inclined from an axial end portion of the planar portion and wherein the protrusion hooks are arranged adjacent to the axial decoupling prevention portions.

9. The turbine according to claim 7, wherein each of the first and second platforms has a flat plate shape, and comprises axial decoupling prevention portions circumferentially inclined from opposite sides of an axial end portion of each of the first and second platforms.

10. The turbine according to claim 1, wherein each of opposite end portions of the fixing member comprises an axial decoupling prevention hook, the axial decoupling prevention hook configured to protrude circumferentially and radially.

11. The turbine according to claim 10, wherein the axial decoupling prevention hook comprises a rivet.

12. The turbine according to claim 1, wherein the at least one first catching groove and the at least one second catching groove have different depths from each other.

13. A turbine comprising:

a rotor wheel comprising:

a plurality of dovetail grooves; and an insertion groove provided between the plurality of dovetail grooves;

a plurality of first buckets, each of the plurality of first buckets comprising a single dovetail configured to engage with a corresponding dovetail groove of the plurality of dovetail grooves, the single dovetail having a first shape corresponding to a shape of each of the plurality of dovetail grooves;

a second bucket comprising a single protrusion inserted into the insertion groove, the single protrusion having a second shape different from the first shape of the single dovetail; and a fixing member configured to be inserted between the single protrusion and the insertion groove, the fixing member configured to restrict radial movement of the second bucket, wherein the insertion groove has a different shape from the plurality of dovetail grooves, the insertion groove comprising axial side walls that extend from an outermost radial surface of the rotor wheel to a bottommost surface of the insertion groove, the axial side walls being opposed to each other and inclined towards each other such that a circumferential distance between the axial side walls continuously decreases from the outermost radial surface of the rotor wheel to the bottoms surface of the insertion groove.

14. The turbine according to claim 13, wherein the fixing member is inserted into each of at least one first catching groove concavely provided on the outer wall of the insertion groove and at least one second catching groove concavely provided on the outer wall of the single protrusion.

15. The turbine according to claim 13, wherein the fixing member has one of a circular cross-sectional shape, an oval cross-sectional shape, and a polygonal cross-sectional shape.

16. The turbine according to claim 13, wherein the fixing member comprises a plurality of fixing members, the plurality of fixing members inserted into each of opposite sides of the single protrusion.

17. The turbine according to claim 14, wherein a circumferential distance between first catching grooves provided on opposite surfaces of the insertion groove and facing each other provided within the insertion groove is decreased as advancing toward a center of the rotor wheel.

18. The turbine according to claim 13, wherein each of the first and second buckets further comprises a shroud which is integrally formed at one end portion thereof.

19. The turbine according to claim 13, wherein each of opposite end portions of the fixing member comprises a deformation portion, and wherein the deformation portion protrudes from a side of the rotor wheel and configured to be mechanically deformed.

20. The turbine according to claim 19, wherein the deformation portion comprises a radially expanded portion.

21. The turbine according to claim 1, wherein the second bucket is configured to inserted into the rotor wheel in a radial direction of the rotor wheel, and the plurality of first buckets are configured to be inserted into the rotor wheel in an axial direction of the rotor wheel.

22. The turbine according to claim 13, wherein the second bucket is configured to inserted into the rotor wheel in a radial direction of the rotor wheel, and the plurality of first buckets are configured to be inserted into the rotor wheel in an axial direction of the rotor wheel.

* * * * *